US007252701B2

(12) United States Patent
Tolvanen

(10) Patent No.: US 7,252,701 B2
(45) Date of Patent: Aug. 7, 2007

(54) METHOD OF CLEANING ELECTRIC FILTER AND ELECTRIC FILTER

(75) Inventor: Juha Tolvanen, Helsinki (FI)

(73) Assignee: ALSTOM Technology Ltd, Baden (CH)

( * ) Notice: Subject to any disclaimer, the term of this patent is extended or adjusted under 35 U.S.C. 154(b) by 82 days.

(21) Appl. No.: 10/559,418

(22) PCT Filed: Jun. 16, 2004

(86) PCT No.: PCT/FI2004/000370

§ 371 (c)(1),
(2), (4) Date: Dec. 7, 2005

(87) PCT Pub. No.: WO2004/112967

PCT Pub. Date: Dec. 29, 2004

(65) Prior Publication Data

US 2007/0095207 A1 May 3, 2007

(30) Foreign Application Priority Data

Jun. 24, 2003 (FI) ..... 20030935

(51) Int. Cl.
*B03C 3/76* (2006.01)

(52) U.S. Cl. ..... 95/74; 95/76; 95/78; 96/32; 96/64

(58) Field of Classification Search ..... 95/74–76, 95/78; 96/32–38, 64
See application file for complete search history.

(56) References Cited

U.S. PATENT DOCUMENTS 1,767,265 A * 6/1930 Sykes ..... 96/62
2,918,137 A * 12/1959 Benoit ..... 96/35
3,504,480 A * 4/1970 Copcutt et al. ..... 96/21
3,988,130 A * 10/1976 Ramsey et al. ..... 96/25
4,026,683 A * 5/1977 Snader et al. ..... 96/37
4,178,156 A 12/1979 Tashiro et al. ..... 95/59
4,218,225 A * 8/1980 Kirchhoff et al. ..... 96/32
4,844,718 A * 7/1989 Schmidt et al. ..... 95/26

(Continued)

FOREIGN PATENT DOCUMENTS

DE 850599 9/1952

(Continued)

OTHER PUBLICATIONS

PCT International Search Report dated Mar. 11, 2004 (PCT/FI2004/000370).

*Primary Examiner*—Richard L. Chiesa
(74) *Attorney, Agent, or Firm*—Arthur E. Fournier, Jr.

(57) ABSTRACT

The invention relates to a method of cleaning an electric filter and to an electric filter. In the method gas containing particles is fed to a chamber (2) of the electric filter. The gas is further fed to gas channels (5) in an emission system (3) provided in the chamber (2). What is brought about is electric charging of the particles in the gas and attachment to the separation electrode (1). Gas purified of particles is removed from the gas channel (5). The separation electrode (1) is shaken with shaker (8) to remove the particles attached to the separation electrode (1) therefrom. In this method, the gas flow is limited in such a gas channel (5) which adjoins the separation electrode (1) to be shaken by the shaker (8) when the separation electrode (1) to be shaken by the shaker (8) is shaken.

4 Claims, 2 Drawing Sheets

U.S. PATENT DOCUMENTS

| | | | | | |
|---|---|---|---|---|---|
| 5,137,546 | A | * | 8/1992 | Steinbacher et al. | 95/71 |
| 5,156,658 | A | * | 10/1992 | Riehl | 96/64 |
| 5,160,510 | A | * | 11/1992 | Steinbacher et al. | 95/64 |
| 5,427,146 | A | | 6/1995 | Bakken et al. | 137/625.3 |
| 2001/0039877 | A1 | | 11/2001 | Hein | 95/69 |

FOREIGN PATENT DOCUMENTS

| | | | | |
|---|---|---|---|---|
| JP | 8-187450 | A | * | 7/1996 |
| WO | WO 97/00727 | A1 | * | 1/1997 |

* cited by examiner

METHOD OF CLEANING ELECTRIC FILTER AND ELECTRIC FILTER

BACKGROUND OF THE INVENTION

The invention relates to a method of cleaning an electronic filter during filtration and to an electric filter.

The emission system of an electric filter is formed of negatively charged emission electrodes and of separation electrodes in a zero position or of ground plates (the separation system, functioning as a positive pool). The gas to be purified of particles is fed through the emission system of the electric filter and the gas flows in the emission system between positively and negatively charged electrodes. Since a tension of approximately 100 kV typically exists between the positively and negatively charged electrodes, such a tension provides corona discharges between the electrodes. The corona discharges cause the particles, when they flow through such a corona discharge, to be mainly negatively charged and attached to the positively charged plates, whereas the positive particles are attached to the emission electrodes.

Different electric filter applications are used for instance in power stations, pulp mills and in various metallurgical processes, in which the electric filters tend to separate particles from the hot gases fed therethrough.

It is previously known in electrical filters to shake the separation electrodes at regular intervals when the electric filter is being used, i.e. during filtration, in order to purify the separation electrodes of the particles attached thereto during filtration. The idea is that the particles removed by shaking fall to the lower part of the electric filter that is preferably but not necessarily provided with a bottom hopper.

What becomes a problem is that when separation electrodes are shaken during filtration, some of the particles removed from the separation electrodes by shaking are conveyed from the electric filter, since a gas flow flows through the electric filter. Thus, what is known as "rapping loss" is created.

A solution to the problem is to close the gas flow flowing through the electric filter completely when the separation electrodes of the electric filter are shaken, but this causes a break in filtration. Another known solution to the problem is of the kind in which two electric filters are used in parallel and in which the gas flow is closed during shaking through the electric filter that is shaken.

Publication U.S. Pat. No. 3,988,130 discloses an electric filter that allows reducing the gas flow in gas channels adjoining the separation electrode to be shaken by shaking means when such a separation electrode to be shaken by the shaking means is shaken simultaneously allowing gas to flow through the other gas channels of the electric filter. Thus, the separation electrodes are allowed to be shaken while using the electric filter without having to stop the electric filter. In this solution, another gas flow is directed against the gas flow flowing in the gas channel so that the gas flow substantially stops in the gas channel concerned. When the separation electrode adjoining the gas channel is shaken, the particles removed from the separation electrode may fall freely for instance to the bottom hopper at the bottom of the electric filter. A problem associated with this prior art solution is that a fairly complicated and space-requiring solution is required to direct a second gas flow against the gas flow flowing in the gas channel.

Publication JP8187450 discloses another electric filter that allows reducing the gas flow in gas channels adjoining a separation electrode to be shaken by a shaking means when such a separation electrode to be shaken by the shaking means is shaken simultaneously allowing gas to flow through the other gas channels of the electric filter. This prior art solution comprises a moving-type curtain that can be moved in front of the up-flow end of the gas intervals, thus preventing the gas flow out of the gas channel. When the separation electrode adjoining the gas channel is shaken, the particles removed from the separation electrodes may freely fall for instance to a bottom hopper at the bottom of the electric filter. A problem in this solution is to move the moving-type curtain reliably in dirty conditions in the electric filter.

BRIEF DESCRIPTION OF THE INVENTION

It is an object of the invention to provide a new method of cleaning an electric filter during filtration and an electric filter.

The object of the invention is achieved with the method and the electric filter, characterized in what is stated in the independent claims.

The preferred embodiments of the invention are disclosed in the dependent claims.

In the invention, a gas flow flowing through an electric filter is limited during shaking in the part of the electric filter in which a separation electrode to be shaken is located so that the velocity of the gas flow flowing through the electric filter in said part is reduced or is more preferably as close as possible to zero, is most preferably zero. To be more precise, the gas flow is at least partly limited or substantially completely closed in the gas channel adjoining the separation electrode to be shaken when the separation electrode is shaken. In the solution according to the invention this is carried out simultaneously as gas is allowed to flow through the electric filter in other parts of the electric filter. In other words, gas is allowed to flow freely through other gas channels. The solution according to the invention allows a particle layer removed by shaking from the separation electrodes to fall as freely as possible to the lower part of the electric filter without stopping the filter.

In this invention the gas flow is limited in the gas channel adjoining the separation electrode to be shaken by moving a first perforated plate arranged in the gas channel in relation to a second perforated plate arranged in the same gas channel as the first perforated plate. The first perforated plate is provided with first apertures and the second perforated plate is provided with second apertures. The first perforated plate is moved in relation to the second perforated plate into a closed position so that the second perforated plate covers at least partly at least one of the first apertures provided in the first perforated plate and thus limits the gas flow through the first aperture, and so that the first perforated plate covers at least partly at least one of the second apertures in the second perforated plate and thus limits the gas flow through the first aperture.

Alternatively the first perforated plate and the second perforated plate may be such that when moving the first perforated plate in relation to the second perforated plate into a closed position, the second perforated plate covers all the first apertures in the first perforated plate and thus prevents the gas flow through the first apertures, and the first perforated plate correspondingly covers all the second apertures in the second perforated plate and thus prevents the gas flow through the second apertures. In this embodiment the first perforated plate and the second perforated plate preferably form a closed plate wall that prevents gas flow.

The first perforated plate and the second perforated plate form in an open position, i.e. in a state in which gas may flow through the first apertures in the first perforated plate and through the second apertures in the second perforated plate, preferably but not necessarily, a gas distribution curtain providing a pressure loss that balances the gas flow. The first perforated plate and the second perforated plate forming the gas distribution curtain are preferably but not necessarily arranged at the end of the gas channel from which gas is removed from the gas channel while gas flows through the gas channel.

The method and electric filter according to the invention provide such an advantage that a small or insignificant rapping loss is achieved. In other words, only a small amount of particles or no particles separated from the separation electrodes by shaking are conveyed with the gas flow out of the electric filter.

The closing means solution according to the invention provides such an advantage that it takes up very little space in the electric filter. This is particularly advantageous if an electric filter in use is provided with such a closing means solution. The first perforated plate as well as the second perforated plate can be made very thin. The first perforated plate and the second perforated plate are preferably but not necessarily arranged in the gas channel successively and fastened to one another in the gas flow direction, and therefore require very little space while moving in relation to one another. In addition, the means for moving the first perforated plate in relation to the second perforated plate can be made very compact.

In the solution according to the invention the gas flow is limited at least partly or the gas flow is closed substantially completely, preferably but not necessarily, in the gas channel on both sides of the separation electrode to be shaken.

In accordance with the invention, the gas flow is timed at least partly in the gas channel adjoining the separation electrode to be shaken by moving the first perforated plate arranged in the gas channel in relation to the second perforated plate arranged in the same gas channel so that the first perforated plate covers at least partly at least one of the second apertures in the second perforated plate and thus at least partly prevents the gas flow through the second aperture, or so that the second perforated plate covers at least one of the first apertures in the first perforated plate and thus at least partly prevents the gas flow through the first aperture.

Each gas channel adjoining the separation electrode to be shaken by the shaking means is preferably but not necessarily provided with closing means so that in the gas channel the velocity of the gas flow can be reduced or more preferably is as close as possible to zero, or is most preferably zero when the separation electrode adjoining the gas channel is shaken. At least one set of closing means, more preferably but not necessarily all closing means comprise a first perforated plate and a second perforated plate.

A preferred embodiment is provided with an ordering means arranged to close the closing means in a certain predetermined order.

A preferred embodiment is provided with a synchronizing means arranged to co-ordinate the operation of the shaking means and preferably but not necessarily such that the closing means at first limit at least partly the gas flow or close the gas flow substantially completely in the gas channel and thereafter shakes the separation electrode adjoining the gas channel by the shaking means.

A preferred embodiment is provided with both an ordering means arranged to act on the closing means in such a manner that the gas flow is at least partly limited or is completely prevented in the gas channel in a certain predetermined order and a synchronizing means that functionally combines the ordering means and the shaking means or the closing means and the shaking means, the shaking means thus performing the shaking of a particular separation electrode when the gas flow in the gas channel adjoining the particular separation electrode is at least partly limited or substantially completely prevented.

BRIEF DESCRIPTION OF THE DRAWINGS

In the following, the invention will be explained in greater detail by means of the preferred embodiments with reference to the accompanying drawings, in which.

DETAILED DESCRIPTION OF THE INVENTION

Figure 1:
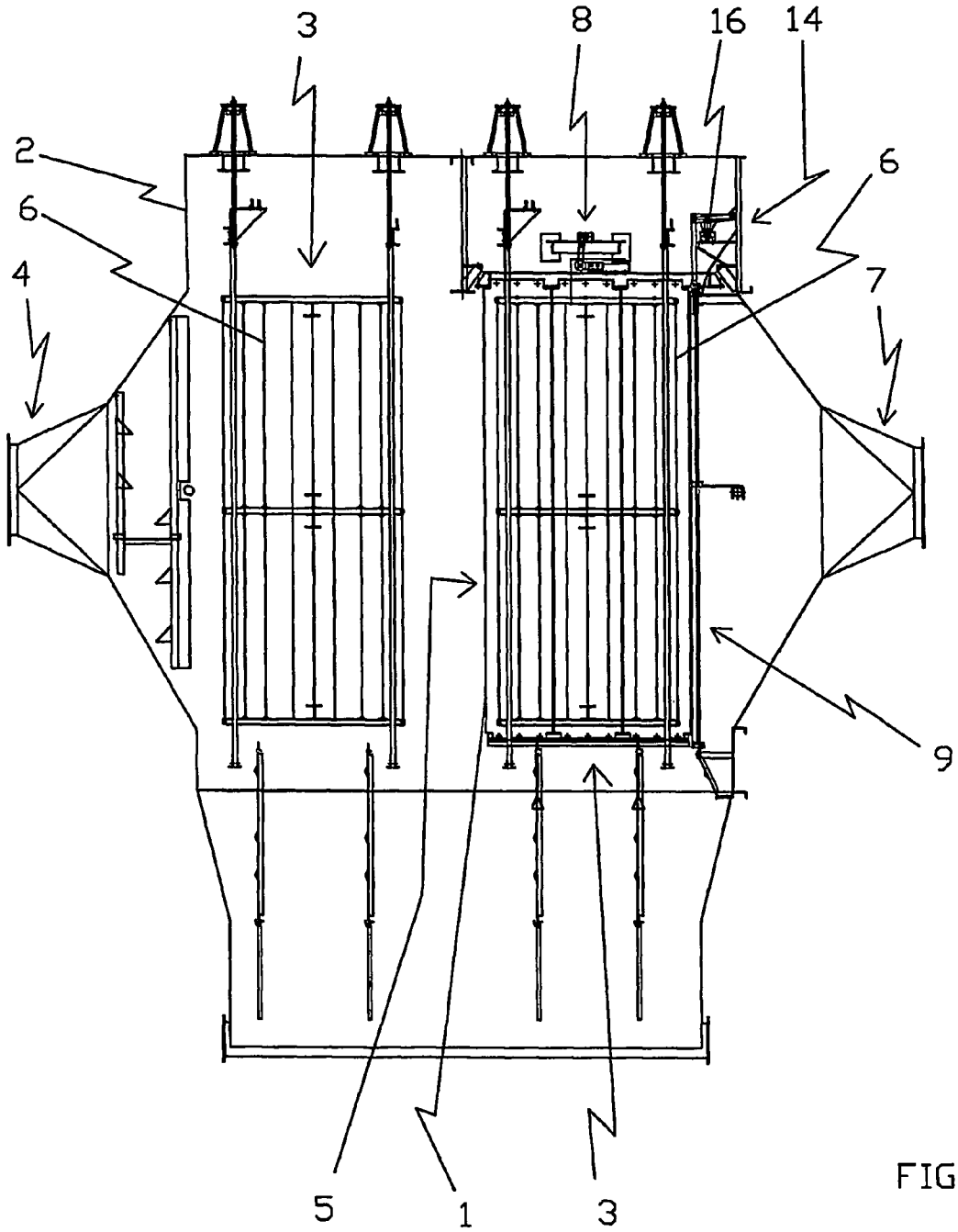
FIG. 1 is a schematic side view in cross-section showing an electric filter.

The invention primarily relates to a method of purifying an electric filter during filtration. In other words the invention primarily relates to a method of purifying separation electrodes 1 in the electric filter of particles (not shown) attached thereto during filtration. The purification is carried out by shaking the separation electrodes 1 while the gas (not shown) to be purified of particles flows into a chamber 2 of the electric filter, particles are removed by means of an emission system 3 provided in the chamber 2 of the electric filter and the gas (not shown) purified of particles is removed from the chamber 2 of the electric filter.

In this method gas containing particles is fed to the chamber 2 of the electric filter by feeding means 4. The gas containing particles is fed further to gas channels in the emission system 3 provided in the chamber 2, the gas channels being formed between two separation electrodes 1 in the emission system 3 provided in the chamber 2 and including at least one electrically charged emission electrode 6. What is achieved is electric charging of the particles in the gas channels 5 and attachment to the separation electrodes 1 and then the gas at least partly purified of particles is removed from the gas channels 5 of the emission system 3. Gas that is at least partly purified of particles is removed from the chamber 2 of the electric filter through exhaust means 7.

It is possible that the emission electrode 6 is for instance a plate-like emission electrode 6 that divides a single gas channel 5 between two separation electrodes 1 into two gas channels 5.

In this method, the separation electrode 1 is shaken by shaking means 8 for removing particles attached to the separation electrode 1 from the separation electrode 1. The shaking means 8 may preferably but not necessarily be provided with the structure described in publication EP 0 833 693 B1 published as WO 97/00727.

The gas flow is limited in this method by closing means 9 at least partly in such a gas channel 5, which adjoins the separation electrode 1 to be shaken by the shaking means 8 when such a separation electrode 1 to be shaken by the shaking means 8 and adjoined to the gas channel 5 is shaken. In the method according to the invention, this is carried out simultaneously as gas to be purified of particles is fed to at least one other gas channel 5, the electric charging of the particles in the gas is achieved in said at least one other gas channel 5 as well as the attachment of the particles to such separation electrodes 1 adjoined to said at least one other gas channel 5, and gas that is at least partly purified of particles is removed from said one other gas channel 5.

More precisely, the gas flow is limited in this method by the closing means 9 comprising a first perforated plate 10 and a second perforated plate 12 by moving the first perforated plate 10 arranged in the gas channel 5 and provided with first apertures 11 in relation to the second perforated plate 12 arranged in the same gas channel 5 as the first perforated plate 10 and provided with second apertures 13 so that the second perforated plate 12 at least partly covers at least one of the first apertures 11 in the first perforated plate and thus limits the gas flow through the first aperture 11, or so that the first perforated plate 10 at least partly covers at least one of the second apertures 13 in the second perforated plate 12 and thus limits the gas flow through the second aperture 13.

Preferably but not necessarily the gas flow is limited by the closing means 9 in the gas channel 5 on both sides of the separation electrode 1 to be shaken at least partly by the shaking means 8 when such a separation electrode 1 to be shaken by the shaking means 8 is shaken by the shaking means 8.

Preferably but not necessarily the gas flow is limited in the gas channel 5 by limiting the gas flow into the gas channel 5.

Preferably but not necessarily the gas flow is limited in the gas channel 5 by limiting the gas flow out of the gas channel 5. The Figure shows an arrangement that is applicable to this embodiment.

Preferably but not necessarily the gas flow is limited in the gas channel 5 by limiting the gas flow into the gas channel 5 and out of the gas channel 5.

Preferably but not necessarily the gas flow is limited in the gas channel 5 before the separation electrode 1 is shaken.

Preferably but not necessarily the gas flow is opened in the gas channel 5 some time after the separation electrode 1 has been shaken.

Preferably but not necessarily the gas flow is closed substantially completely by the closing means 9 in such a gas channel 5 which adjoins the separation electrode 1 to be shaken by the shaking means 8 when the separation code 1 adjoined to the gas channel 5 and to be shaken by the shaking means is shaken. In the method according to the invention, this is carried out simultaneously as the gas to be purified of particles is fed to at least one other gas channel 5 and electric charging of the particles in the gas is achieved in at least one other gas channel 5 as well as the attachment of the particles to such separation electrodes 1, which are adjoined to the at least one other gas channel 5, and gas at least partly purified of particles is removed from said one other gas channel 5.

Preferably but not necessarily the gas flow is limited by the closing means 9 comprising the first perforated plate 10 and the second perforated plate 12 by moving the first perforated plate 10 arranged in the gas channel 5 and provided with the first apertures 11 in relation to the second perforated plate 12 arranged in the same gas channel 5 as the first perforated plate 10 and provided with the second apertures 13 in such a manner that the second perforated plate 12 covers all the first apertures 11 in the first perforated plate 10 and thus prevents the gas flow through the first apertures 11, or in such a manner that the first perforated plate 10 covers all the second apertures 13 in the second perforated plate 12 and thus prevents the gas flow through the second apertures 13.

Preferably but not necessarily the gas flow is closed substantially completely in the gas channel 5 on both sides of the separation electrode 1 to be shaken by the shaking means 8 when such a separation electrode 1 to be shaken by the shaking means 8 is shaken.

Preferably but not necessarily the gas flow is closed substantially completely in the gas channel 5 by preventing the gas from flowing into the gas channel 5.

Preferably but not necessarily the gas flow is closed substantially completely in the gas channel 5 by preventing the gas from flowing out of the gas channel 5.

Preferably but not necessarily the gas flow is closed substantially completely in the gas channel 5 by preventing the gas from flowing into the gas channel 5 and preventing the gas from flowing out of the gas channel 5.

Preferably but not necessarily the gas flow is closed substantially completely in the gas channel 5 before the separation electrode 1 is shaken.

Preferably but not necessarily the gas flow is opened in the gas channel 5 some time after the separation electrode 1 has been shaken.

It is obvious for those skilled in the art that the emission electrode 6 can also if necessary be shaken and that with a corresponding method the gas flow can be limited in the gas channel 5 adjoining the emission electrode 6 to be shaken or closed substantially completely.

The invention also relates to an electric filter comprising a chamber 2 including feeding means 4 for feeding gas to be purified of particles to the chamber 2, the chamber 2 including an emission system 3 comprising several separation electrodes 1 forming gas channels 5 between them, the gas channels 5 being provided with emission electrodes 6 that can be electrically charged, and the chamber 2 including exhaust means 7 for feeding gas purified of particles from the chamber 2.

In the Figure the separation electrodes 1 are substantially rectangular metal plates.

It is possible that at least one emission electrode 6 in at least one gas channel 5 is provided with such a structure that divides the gas channel 5 between the separation electrode 1 into two gas channels 5. It is possible for instance that the structure includes such emission electrodes 6, which are substantially rectangular metal plates.

The electric filter also comprises shaking means 8 for shaking off particles from at least one separation electrode 1. The shaking means 8 may preferably but need not necessarily be provided with the structure depicted in publication EP 0 833 693 B1 published as WO 97/00727.

The gas flow can at least partly be limited by closing means 9 in such a gas channel 5 which adjoins the separation electrode 1 to be shaken by the shaking means 8 simultaneously as gas to be purified of particles can be fed to at least one other gas channel 5 and gas that is at least partly purified of particles can be removed from the at least one gas channel 5.

Preferably but not necessarily the gas flow can at least partly be limited by the closing means 9 in the gas channel 5 on both sides of the separation electrode 1 to be shaken by the shaking means 8.

Preferably but not necessarily the gas flow can be limited by the closing means 9 into the gas channel 5.

Preferably but not necessarily the gas flow can be limited by the closing means 9 out of the gas channel 5.

Preferably but not necessarily the gas flow can be limited by the closing means 9 into the gas channel 5 and out of the gas channel 5.

Preferably but not necessarily the gas flow can be substantially completely closed by the closing means 9 in such a gas channel 5, which adjoins the separation electrode 1 to be shaken by the shaking means 8 simultaneously as gas purified of particles can be fed to at least one other gas channel 5 and gas that is at least partly purified of particles can be removed from the other gas channel 5.

Preferably but not necessarily the gas flow can be substantially completely closed by the closing means 9 in the gas channel 5 on both sides of the separation electrode 1 to be shaken by the shaking means 8.

Preferably but not necessarily the gas flow into the gas channel 5 can be substantially completely closed by the closing means 9.

Preferably but not necessarily the gas flow out of the gas channel 5 can be substantially completely closed by the closing means 9.

Preferably but not necessarily the gas flow into the gas channel 5 and out of the gas channel 5 can be substantially completely closed by the closing means 9.

In the Figures the closing means 9 comprise a first perforated plate 10 arranged in the gas channel 5 and provided with first apertures 11. In the Figures the closing means 9 also comprise a second perforated plate 12 arranged in the same gas channel 5 as the first perforated plate 10 and provided with second apertures 13.

Figure 2:
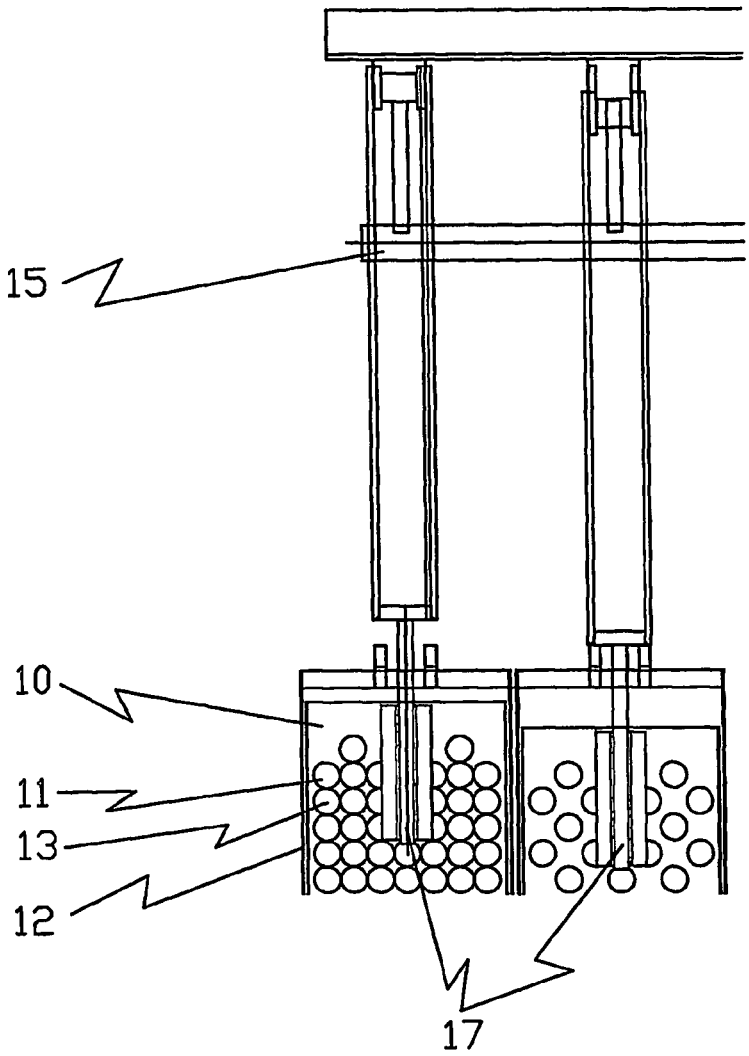
FIG. 2 is a schematic view showing an upper part of closing means.

The first perforated plate 10 can be moved in relation to the second perforated plate 12 into an open position, in which gas may flow through the first apertures 11 in the first perforated plate 10 and the second apertures 13 in the second perforated plate 12. In FIG. 2 the closing means 9 on the right comprising the first perforated plate 10 and the second perforated plate 12 is in the open position.

The first perforated plate 10 can also be moved in relation to the second perforated plate 12 into a closed position, in which the second perforated plate 12 at least partly covers at least one of the first apertures 11 in the first perforated plate 10 and thus at least partly limits the gas flow through the first aperture 11, and in which the first perforated plate 10 at least partly covers at least one of the second apertures 13 in the second perforated plate 12 and thus at least partly limits the gas flow through the second aperture 13.

More preferably but not necessarily the first perforated plate 10 can be moved in relation to the second perforated plate 12 to such a closed position, in which the second perforated plate 12 covers all the first apertures 11 in the first perforated plate 10 and thus prevents the gas flow through the first apertures 11 and in which the first perforated plate 10 correspondingly covers all the second apertures 13 in the second perforated plate 12 and thus prevents the gas flow through the second apertures 13. In FIG. 2 the closing means 9 on the left comprising the first perforated plate 10 and the second perforated plate 12 is in such a closed position.

The separation system of the electric filter shown in the Figures comprises several gas channels 5 and each gas channel is provided with the closing means 9 comprising the first perforated plate 10 and the second perforated plate 12.

Alternatively the closing means 9 may comprise another type of arrangement to at least partly limit the gas flow or to close it substantially completely in the gas channel 5. Examples of such arrangements include rotatable doors, butterfly valves or the like.

The electric filter preferably comprises an ordering means 14 arranged to activate the closing means 9 in the gas channels 5 in a certain predetermined order so that the gas flow is at least partly limited or is substantially completely closed in the gas channels 5 in a certain predetermined order.

The ordering means 14 referred to in the Figures comprises a camshaft 15. The camshaft 15 is provided with cams 16 arranged to act on the first perforated plates 10 in such a manner that the first perforated plates 10 move in a certain predetermined order in relation to the second perforated plates 12 between the open position and the closed position.

The camshaft 15 extends above the closing means 9 comprising the first perforated plate 10 and the second perforated plate 12 and comprises cams 16, which rotate with the camshaft about the longitudinal axis thereof while the camshaft rotates about the longitudinal axis (not indicated with a reference numeral) thereof.

The cams 16 of the camshaft 15 are arranged to lift in a certain predetermined order either (i) one first perforated plate 10 in one gas channel 5 so that the gas flow through the first apertures 11 in the first perforated plate 10 and the second apertures 13 in the second perforated plate 12 is at least partly limited or substantially completely prevented in the gas channel 5 moving on one side of the separation electrode 1, or (ii) two first perforated plates 10 in two adjacent gas channels 5 adjoining the same separation electrode 1 so that the gas flow through the first apertures 11 in the first perforated plate 10 and the second apertures 13 in the second perforated plate 12 is at least partly limited or substantially completely prevented in the gas channel 5 on both sides of the separation electrode 1.

Alternative (i) is applicable to be used for instance on the borders of the emission system, in which a gas channel 5 typically moves only on one side of the separation electrode 1. Cf. for instance the outermost gas channels in FIG. 2.

In the Figures the first perforated plates 10 are functionally connected to the cams by means of arm arrangements 17 fastened to the first perforated plates 10.

In the arrangement shown in the Figures, the first perforated plates 10 are arranged to return into the open position by means of gravity. When falling down, the first perforated plate 10 is preferably but not necessarily arranged to be shaken and thus to be purified of particles.

Alternatively the camshaft 15 may be replaced by another arrangement, which is in a certain predetermined order arranged to lift one first perforated plate 10 so that the gas flow through the first apertures 11 in the first perforated plate 10 and the second apertures 13 in the second perforated plate 12 is at least partly limited or substantially completely prevented in such a gas channel which adjoins the separation electrode to be shaken by the shaking means.

The electric filter preferably comprises a synchronizing means (not shown) arranged to co-ordinate the function of the closing means 9 and the shaking means 8.

The synchronizing means may be a mechanical device that connects the closing means 9 to the shaking means 8. Alternatively the synchronizing means may be a device that sends for instance a signal from the closing means 9 to the shaking means 8 about the fact that the closing means 9 have at least partly or completely closed the gas channel 5 and that the shaking means 8 are able to shake the separation electrode 1 adjoining the gas channel 5.

The synchronizing means is preferably but not necessarily arranged to activate the shaking means 8 not until the closing means 9 has at least partly limited or substantially completely closed the gas flow in the gas channel 5.

The synchronizing means is preferably but not necessarily arranged to open the closing means 9 some time after the separation electrode 1 has been shaken.

It is obvious for those skilled in the art that the electric filter may also comprise an arrangement for shaking at least one emission electrode 6 and a corresponding arrangement for limiting or closing the gas flow in the gas channel 5 adjoining the emission electrode 6.

It is obvious for those skilled in the art that as technology advances the basic idea of the invention can be implemented in various ways. The invention and the preferred embodiments thereof are therefore not restricted to the above examples but they may vary within the scope of the claims.

The invention claimed is:

1. A method of cleaning an electric filter during filtration, said method comprising the steps of:

feeding gas containing particles to a chamber of the electric filter by feeding means, feeding the gas containing particles further to gas channels in an emission system provided in the chamber, the gas channels being formed between separation electrodes in the emission system provided in the chamber and including emission electrodes, effecting electric charging of the particles in the gas and the attachment thereof to the separation electrode, removing the gas that has been at least partly purified of particles from the gas channel of the emission system, removing the gas that has been at least partly purified of particles from the chamber of the electric filter through exhaust means, shaking the separation electrode with shaking means to remove the particles attached to the separation electrode therefrom, limiting the gas flow at least partly in such a gas channel that adjoins the separation electrode to be shaken by the shaking means when the separation electrode to be shaken by the shaking means is shaken whereby the shaking of the separator electrode with the shaking means is synchronized with the limiting of the gas flow such that the limiting of the gas flow occurs first followed thereafter by the shaking of the separation electrode, and in that the gas flow is limited by moving in a certain predetermined order a first perforated plate arranged in the gas channel and provided with first apertures in relation to a second perforated plate arranged in the same gas channel as the first perforated plate and provided with second apertures so that either the second perforated plate at least partly covers at least one of the first apertures provided in the first perforated plate and thus limits the gas flow through the first aperture or the first perforated plate at least partly covers at least one of the second apertures in the second perforated plate and thus limits the gas flow through the second aperture.

2. The method according to claim 1, the gas flow is limited in the gas channel on each side of the separator electrode to be shaken by shaking means when the separation electrode to be shaken is shaken by the shaking means.

3. An electric filter comprising:

a chamber including feeding means for feeding gas to be purified of particles to the chamber, separation electrodes forming gas channels between the separation electrodes, the gas channels being provided with emission electrodes that can be electrically charged, exhaust means for feeding gas purified of particles from the chamber, shaking means for shaking off particles from at least one separation electrode, closing means arranged in each gas channel for at least partly limiting the gas flow in each gas channel, synchronizing means arranged to co-ordinate the operation of the closing means and the shaking means such that after the closing means has at least partly limited the gas flow in the gas channel when the shaking means is activated to effect therewith the shaking of the separation electrode, and the closing means comprises in each gas channel a first perforated plate provided with first apertures and a second perforated plate provided with second apertures, the first perforated plate in each gas channel being movable in relation to the second perforated plate so that either the second perforated plate at least partly covers at least one of the first apertures provided in the first perforated plate and thus limits the gas flow through the first aperture or the first perforated plate at least partly covers at least one of the second apertures in the second perforated plate and thus limits the gas flow through the second aperture.

4. The electric filter according to claim 3, wherein the gas flow is at least partly limited in the gas channel on each side of the separation electrode when the separation electrode to be shaken is shaken by the shaking means.

* * * * *